US007214106B2

(12) United States Patent
Sweetland

(10) Patent No.: US 7,214,106 B2
(45) Date of Patent: May 8, 2007

(54) ELECTRICAL CONNECTOR

(75) Inventor: Matthew Sweetland, Bedford, MA (US)

(73) Assignee: Tribotek, Inc., Burlington, MA (US)

( * ) Notice: Subject to any disclaimer, the term of this patent is extended or adjusted under 35 U.S.C. 154(b) by 0 days.

(21) Appl. No.: 11/183,562

(22) Filed: Jul. 18, 2005

(65) Prior Publication Data

US 2007/0015419 A1 Jan. 18, 2007

(51) Int. Cl.
*H01R 11/09* (2006.01)

(52) U.S. Cl. ..... 439/723; 439/724; 439/263

(58) Field of Classification Search ..... 439/263, 439/839, 930, 723, 724, 82, 659, 843
See application file for complete search history.

(56) References Cited

U.S. PATENT DOCUMENTS

| | | | | |
|---|---|---|---|---|
| 1,012,030 | A | | 12/1911 | Underwood |
| 2,904,771 | A | * | 9/1959 | Burtt ..... 439/654 |
| 2,975,254 | A | | 3/1961 | Yanagisawa |
| 3,197,555 | A | | 7/1965 | Mittler |
| 3,257,500 | A | | 6/1966 | Rusch |
| 3,371,250 | A | | 2/1968 | Ross |
| 3,447,120 | A | | 5/1969 | Rask |
| 3,476,870 | A | | 11/1969 | Ross |
| 3,495,025 | A | | 2/1970 | Ross |
| 3,557,428 | A | | 1/1971 | Bonhomme |
| 3,631,298 | A | | 12/1971 | Davis |
| 3,639,978 | A | | 2/1972 | Schurman |
| 3,654,381 | A | | 4/1972 | Copp |
| 3,676,923 | A | | 7/1972 | Reimer |
| 3,702,895 | A | | 11/1972 | de Sio |
| 3,711,627 | A | | 1/1973 | Maringulov |
| 3,909,508 | A | | 9/1975 | Ross |
| 3,927,284 | A | | 12/1975 | Andersson |
| 3,984,622 | A | | 10/1976 | Ross |
| 4,082,423 | A | | 4/1978 | Glista |
| 4,123,899 | A | | 11/1978 | Windelbandt |
| 4,128,293 | A | * | 12/1978 | Paoli ..... 439/843 |
| 4,206,958 | A | * | 6/1980 | Hall et al. ..... 439/291 |
| 4,218,581 | A | | 8/1980 | Suzuki |
| 4,462,657 | A | | 7/1984 | Snowdon |
| 4,463,323 | A | | 7/1984 | Piper |
| 4,508,401 | A | | 4/1985 | Casciotti |
| 4,518,648 | A | | 5/1985 | Miyata |
| 4,568,138 | A | * | 2/1986 | McKenzie ..... 439/723 |
| 4,639,054 | A | | 1/1987 | Kersbergen |

(Continued)

FOREIGN PATENT DOCUMENTS

DE 10 2004 002 405 B3 7/2005

(Continued)

*Primary Examiner*—Tulsidas C. Patel
*Assistant Examiner*—Harshad C Patel
(74) *Attorney, Agent, or Firm*—Wolf, Greenfield & Sacks, P.C.

(57) ABSTRACT

Electrical connectors are adapted to provide a reliable electrical connection to mating elements of a mating connector. The connector can have sockets that accept mating elements of the mating connector. Conductors of the connector are associated with each socket and make electrical contact with mating elements received therein. A loading band of the connector is tensioned to provide a contact force between the conductor and the mating element when the mating connector is in the socket. Electrical connectors constructed in this manner can provide increased current density and/or a more reliable connection between the conductors and the mating element.

56 Claims, 7 Drawing Sheets

U.S. PATENT DOCUMENTS

| | | | | | |
|---|---|---|---|---|---|
| 4,651,163 | A | | 3/1987 | Sutera | |
| 4,664,185 | A | | 5/1987 | Barnard | |
| 4,710,594 | A | | 12/1987 | Walling | |
| 4,741,707 | A | | 5/1988 | Mondor, III | |
| 4,753,616 | A | * | 6/1988 | Molitor | 439/787 |
| 4,755,422 | A | | 7/1988 | Headrick | |
| 4,778,950 | A | | 10/1988 | Lee | |
| 4,813,881 | A | * | 3/1989 | Kirby | 439/74 |
| 4,820,170 | A | | 4/1989 | Redmond | |
| 4,820,207 | A | * | 4/1989 | Zic | 439/825 |
| 4,929,803 | A | | 5/1990 | Yoshida | |
| 4,940,426 | A | | 7/1990 | Redmond | |
| 4,956,524 | A | | 9/1990 | Karkow | |
| 5,015,197 | A | | 5/1991 | Redmond | |
| 5,070,605 | A | | 12/1991 | Daglow | |
| 5,073,124 | A | * | 12/1991 | Powell | 439/197 |
| 5,109,596 | A | | 5/1992 | Driller | |
| 5,163,837 | A | | 11/1992 | Rowlette, Sr. | |
| 5,176,535 | A | | 1/1993 | Redmond | |
| 5,190,471 | A | | 3/1993 | Barile | |
| 5,273,438 | A | | 12/1993 | Bradley | |
| 5,281,160 | A | * | 1/1994 | Walkup et al. | 439/266 |
| 5,447,442 | A | | 9/1995 | Swart | |
| 5,468,164 | A | | 11/1995 | Demissy | |
| 5,469,072 | A | | 11/1995 | Williams | |
| 5,533,693 | A | | 7/1996 | Abildskov | |
| 5,564,931 | A | | 10/1996 | Fabian | |
| 5,565,654 | A | * | 10/1996 | Zell et al. | 174/265 |
| 5,635,677 | A | | 6/1997 | Wood | |
| 5,645,459 | A | | 7/1997 | Fitting | |
| 5,676,571 | A | * | 10/1997 | Matthews | 439/843 |
| 5,769,656 | A | | 6/1998 | Bamburg | |
| 5,880,402 | A | | 3/1999 | Nugent | |
| 5,899,755 | A | | 5/1999 | Kline | |
| 5,899,766 | A | | 5/1999 | DeFeo | |
| 6,019,642 | A | | 2/2000 | Nagata | |
| 6,086,432 | A | | 7/2000 | Frinker | |
| 6,102,746 | A | | 8/2000 | Nania | |
| 6,135,783 | A | | 10/2000 | Rathburn | |
| 6,210,771 | B1 | | 4/2001 | Post | |
| 6,250,966 | B1 | | 6/2001 | Hashimoto | |
| 6,264,476 | B1 | | 7/2001 | Li | |
| 6,313,523 | B1 | | 11/2001 | Morris | |
| 6,386,890 | B1 | | 5/2002 | Bhatt | |
| 6,388,885 | B1 | | 5/2002 | Alexander | |
| 6,439,894 | B1 | | 8/2002 | Li | |
| 6,471,555 | B2 | * | 10/2002 | Creze | 439/843 |
| 6,598,290 | B2 | | 7/2003 | Hembree et al. | |
| 6,666,690 | B2 | | 12/2003 | Ishizuka | |
| 6,722,893 | B2 | | 4/2004 | Li et al. | |
| 6,762,941 | B2 | | 7/2004 | Roth | |
| 6,852,395 | B2 | | 2/2005 | Dhawan | |
| 6,944,296 | B1 | | 9/2005 | Sweetland | |
| 6,945,790 | B2 | | 9/2005 | Sweetland | |
| 6,951,465 | B2 | | 10/2005 | Sweetland | |
| 7,021,957 | B2 | | 4/2006 | Sweetland | |
| 2001/0018298 | A1 | | 8/2001 | Takaya et al. | |
| 2002/0016108 | A1 | | 2/2002 | Gilman | |
| 2002/0102868 | A1 | | 8/2002 | Li | |
| 2002/0117791 | A1 | | 8/2002 | Hembree | |
| 2003/0176083 | A1 | | 9/2003 | Li | |
| 2004/0048500 | A1 | | 3/2004 | Sweetland | |
| 2004/0171284 | A1 | | 9/2004 | Sweetland | |
| 2004/0214454 | A1 | | 10/2004 | Sweetland | |
| 2005/0014421 | A1 | | 1/2005 | Sweetland | |
| 2005/0045461 | A1 | | 3/2005 | Sweetland | |
| 2005/0159028 | A1 | | 7/2005 | Sweetland | |
| 2005/0202695 | A1 | | 9/2005 | Sweetland | |
| 2005/0239329 | A1 | | 10/2005 | Sweetland | |

FOREIGN PATENT DOCUMENTS

| | | |
|---|---|---|
| EP | 0 176 607 | 4/1986 |
| EP | 0512714 A1 | 11/1992 |
| EP | 0 901 191 A2 | 3/1999 |
| EP | 0 932 172 A2 | 7/1999 |
| JP | 6 118 818 | 8/1986 |
| JP | 6 176 624 | 6/1994 |
| JP | 6 251 819 | 9/1994 |
| JP | 7 037 433 | 2/1995 |
| JP | 8 106 939 | 4/1996 |
| WO | WO 95/08910 | 3/1995 |
| WO | WO 01/75788 A1 | 10/2001 |

* cited by examiner

ELECTRICAL CONNECTOR

BACKGROUND OF INVENTION

1. Field of Invention

The invention relates to electrical connectors.

2. Discussion of Related Art

Electrical connectors are used to provide a separable path for electric current to flow between components of an electrical system. In many applications, numerous connections between components can, in turn, require numerous data and/or power connections within a given electrical connector. Lately, there has been increase in the number of connections required for typical electronic components, which in turn has created a demand for greater numbers of electrical connections in electrical connectors. There has also been a general reduction in the size of electronic components, which has created demand for smaller electrical connectors. For either of these reasons, there is a need for electrical connectors with increased current density, where "current density" refers to the amount of current passed through a given connector divided by the area of the connector. By way of example, there is a current demand for connectors that can mate with circular pins that are between 0.050" and 0.020" in diameter (or square pins with edges of similar cross sectional length) that are spaced from one another on a pitch between 0.15" and 0.05". Some of these electrical connectors are required to handle as much as 5 to 20 amps per connection within the connector. Existing technologies cannot meet these requirements while also providing reliable electrical connections.

The applicant also appreciates that in many applications, particularly those involving small conductors, it can be desirable to maximize the contact area between a conductor and a mating element. Connectors with conductors that make contact over a larger area or that produce multiple contact points per connection can often support greater amounts of current flowing through the connector, and in doing so can provide connectors that can support an increased current density.

Greater contact forces can provide for a more reliable electrical connection by preventing separation of the conductor and mating element. Additionally, higher normal contact forces can cause wiping action between the conductor and the mating element when they are engaged in a sliding manner. This wiping action can help remove debris that might be on the conductor or mating element, which might otherwise reduce the reliability of the connection. Wiping action can also help break oxide layers that can limit conductivity. However, there can be drawbacks to high normal contact forces. Higher contact forces can substantially increase the insertion force required to engage the connector with the mating surface. An operator, attempting to overcome such high insertion forces, may damage the connector. Additionally, the wiping action associated with higher contact forces can cause wear of the conductor and/or mating surface, including removal of desirable coatings, which can lead to oxidation and poor electrical connections.

Electrical connectors are known to use conductors that are displaced under an elastic load during engagement with a mating surface to provide contact forces. However, applicant appreciates that requiring the conductor to be optimized for both transmitting a current and applying a contact force in this manner often requires compromises to be made when choosing materials or configurations for conductors. By way of example, applicant appreciates that high conductivity copper alloys, which have desirable electrical properties, are avoided for use in electrical connectors because of stress relaxation and creep that may occur over time or repeated use. High conductivity copper alloy, as the term is used herein, refers to alloys that have at least 90% of the conductivity of metals made of 99.99% copper. Attempts to improve the mechanical properties of copper with small quantities of alloying agent, such as 0.5% Beryllium, can reduce the conductivity of the alloy to as low as 20% of the conductivity of pure copper.

SUMMARY OF INVENTION

According to one aspect of the invention, a multi-socket electrical connector is disclosed. The multi-socket electrical connector comprises an insulating base and a plurality of sockets on a first side of the base, each socket constructed and arranged to receive a corresponding mating element of a mating connector. The multi-socket electrical connector also comprises a first conductor associated with each socket. The first conductor of each socket is adapted to contact a first lateral side of the corresponding mating element. The multi-socket electrical connector also comprises a first loading band adapted to be tensioned to provide a contact force between the first conductor of each socket and the corresponding mating element.

According to another aspect of the invention, an electrical connector comprises an insulating base and a first socket on a first side of the base and extending inwards of the base. The first socket is constructed and arranged to receive a first mating element of a mating connector from the first side. The electrical connector also comprises a second socket on a second side of the base and extending inward of the base from the second side. The second socket is constructed and arranged to receive a second mating element of a mating connector from the second side. The electrical connector also comprises a first conductor associated with the socket. The first conductor is adapted to contact the first mating element when present in the socket and to contact the second mating element when present in the socket. The electrical connector also comprises a first loading band in the base adapted to be tensioned to provide a contact force between the first conductor and the first mating element when present in the socket and a second loading band in the base adapted to be tensioned to provide a contact force between the first conductor and the second mating element when present in the socket.

According to another aspect of the invention, a method for engaging a multi-socket electrical connector with a plurality of mating elements is disclosed. The method comprises providing an electrical connector having a plurality of sockets and inserting each of a plurality of mating elements of a mating connector into a corresponding socket of the electrical connector. The method also comprises contacting a lateral side of each of the plurality of mating elements of the mating connector to a first conductor of the corresponding socket of the electrical connector and displacing a first loading band in the electrical connector to provide a contact force between each of the plurality of mating elements and the first conductor of the corresponding socket.

According to yet another aspect of the invention, a method for engaging a first and a second male electrical elements is disclosed. The method comprises inserting the first male element into a first socket of an electrical connector and displacing a first loading band in the electrical connector to provide a first contact force between the first element and a conductor of the socket. The method also comprises inserting the second male element into a second socket of the electrical connector and displacing a second loading band in the electrical connector to provide a second contact force between the second element and the conductor of the socket.

According to still another aspect of the invention, a multi-socket electrical connector is disclosed that comprises an insulative base and a plurality of sockets disposed substantially in a linear row on a first side of the base and extending inwardly of the base in a first direction. Each socket is constructed and arranged to receive a corresponding mating element of a mating connector. The multi-socket electrical connector also comprises a plurality of wire conductors disposed in each socket, at least some of the plurality of wire conductors adapted to contact the corresponding mating element and a plurality of tensioned loading bands engaging at least some of the plurality of wire conductors in each socket, each loading band anchored to the insulative base and adapted to be tensioned upon the corresponding mating element being received in each socket, whereby the loading band provides multiple points of contact between the at least some of the plurality of wire conductors and the corresponding mating element.

Various embodiments of the present invention provide certain advantages. Not all embodiments of the invention share the same advantages and those that do may not share them under all circumstances. Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, similar features are represented by like reference numerals. For clarity, not every component is labeled in every drawing. In the drawings.

Figure 1:
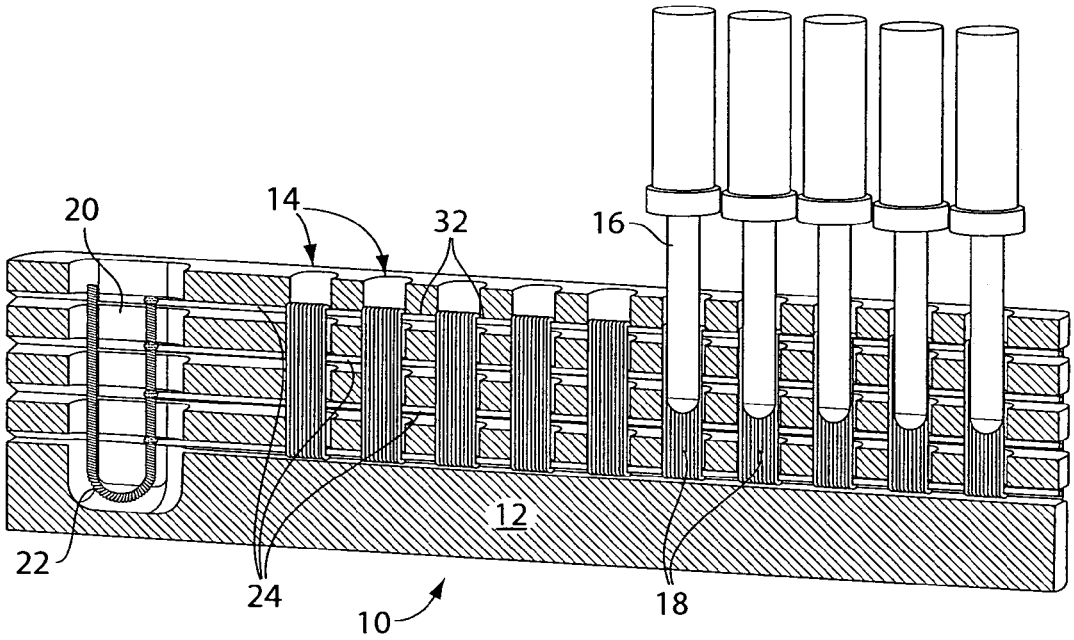
FIG. 1 shows a partial view of one embodiment of an electrical connector with a row of sockets that can receive mating elements of mating connector.

Other aspects, embodiments and features of the invention will become apparent from the following detailed description of the invention when considered in conjunction with the accompanying figures. All patent applications and patents incorporated herein by reference are incorporated by reference in their entirety. In case of conflict, the present specification, including definitions, will control

DETAILED DESCRIPTION

Electrical connectors of the present invention are adapted to provide an electrical connection to mating elements of a mating connector at an increased power density and/or of a higher mechanical reliability. Embodiments of the connector have sockets that accept conductive mating elements of the mating connector. Conductors of the connector are included in each socket and make electrical contact with mating elements received therein. A loading band in the connector is tensioned to provide a contact force between the conductor and the mating element when the mating connector is in the socket.

Electrical connectors that can engage multiple conductive mating elements in a body of the electrical connector body can have relatively high current densities for either data and/or power applications. Typically, such electrical connectors employ between 0.040" and 0.02" diameter pins and/or sockets on 0.15" to 0.05" center-to-center distances (also referred to as "pitches"). As discussed herein, one or more loading bands can be used to provide contact forces between conductors of multiple sockets of the electrical connector and pins of a mating connector located in each of the multiple sockets. That is, according to the present invention, each individual socket is not required to have its own individual set of loading bands. Instead, the present invention contemplates efficiencies, and thus increased power or data current densities, by employing a single loading band or sets of loading bands across multiple, distinct power and/or data sockets.

According to another aspect, the connector is configured in a manner so that it can receive pins of any cross-sectional shape (such as square or rectangular) in a socket that may have a generally circular cross-section. This may be accomplished by employing multiple wire conductors that together exert a contact force on the mating pin via the loading band. The multiple conductors are loosely grouped together such that individual wire conductors may move to accommodate the varying shapes of the mating pin. For example, the wires may move such that a larger subset of the wires engage with the flat part of the pin, whereas a smaller subset (or even one conductor) engages with the pin at or near the edge of the pin. Conductors that can conform to the mating pin in this manner can provide an increased contact area, which can allow the connector to handle a greater current, thus increasing the current density of the connector.

In some illustrative embodiments of the invention, the connector has a plurality of sockets in an insulating base of the connector. One or more conductors that can conform to a surface of the mating element are a part of each of the sockets. One or more loading bands are positioned such that when the mating elements are received in the sockets, the loading bands are tensioned and, in turn, provide contact forces between the conductors and the mating elements. Embodiments of connectors constructed in this manner can accommodate numerous mating elements to a high current density connector. Additionally, such embodiments having conductors that can conform to different shapes and sizes of mating elements are versatile as they can be used in a wide variety of applications.

In some embodiments, the connector provides an electrical connection between a first mating element of one mating connector and a second mating element of another connector. In some of such embodiments, the connector has sockets that receive one of a first mating element and a second element. Each of the first and second mating elements contact a common conductor within the connector. Loading bands in the connector are tensioned to provide contact forces between the conductor and each of the first and second mating element when present in the socket. The loading bands can help ensure a reliable electrical connection between the conductor and each of the first and second mating elements in an socket.

Turn now to the figures, and initially FIG. 1, which shows a schematic view of one half of a connector 10 according to one embodiment. The illustrated connector embodiment has a base 12 (one half of the base is shown) that defines a row of sockets 14. In the illustrated embodiment, the base is electrically insulative, but can be conductive in other embodiments. The sockets can each receive a mating element 16 of a mating connector. Conductors 18 extend along a length of each socket 14 and are positioned to make contact with mating elements when received in the socket. The base 12 has a pocket 20 that retains a loading element 22, such as a spring, that is connected to loading bands 24 that extend along the row of sockets. The loading bands are positioned between the base and the conductors and pass by loading guides 32 located on either side of each socket. When the mating elements are present in the sockets, the conductors are displaced toward the loading bands, which causes the loading bands to be placed in tension. Placing the loading bands in tension, in turn, creates contact forces between the mating elements and the conductors. Loading guides can help hold the loading bands and conductors near the mating elements and can also help create contact forces between the conductors and mating elements.

Figure 2:
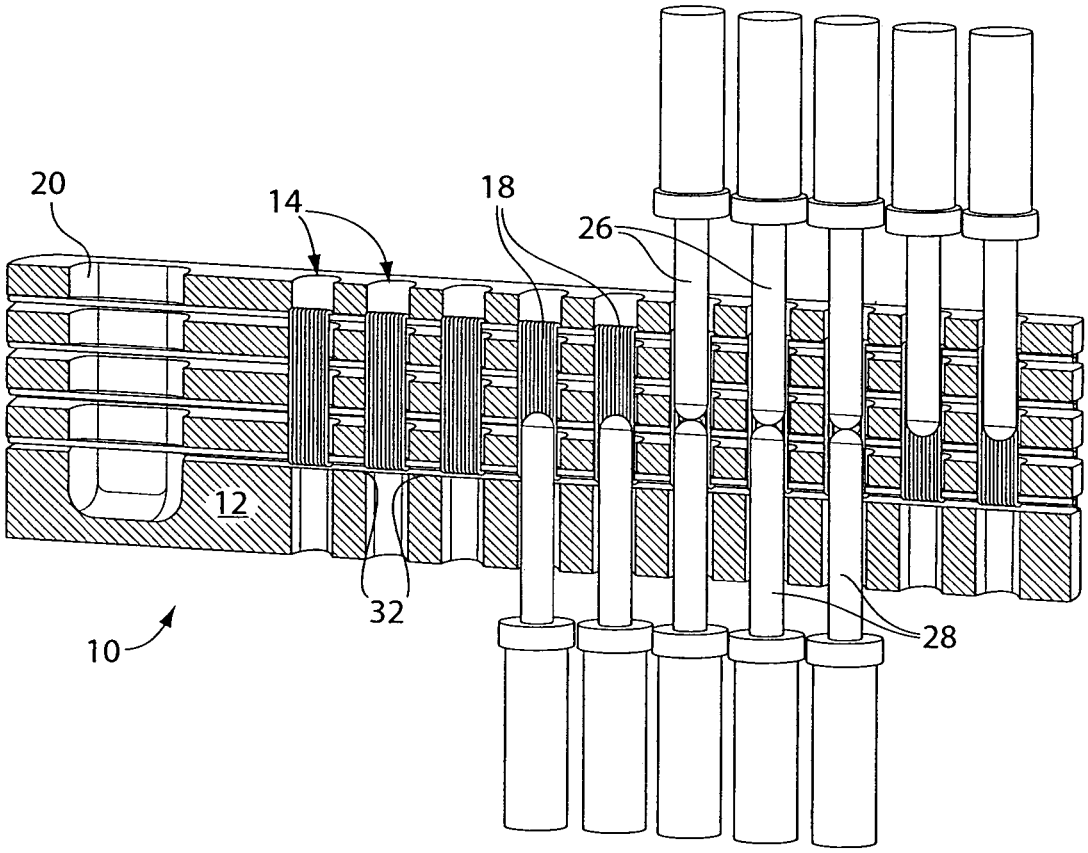
FIG. 2 shows a partial view of an electrical connector that provides an electrical connection between separate mating elements that are each inserted into sockets of the connector.

As mentioned above, some embodiments of connectors provide an electrical connection between first and second mating elements 26, 28 that are inserted into a socket 14 of the connector. FIG. 2 shows a view of a portion of an embodiment of such a connector. Cylindrical sockets 14 extend through a base 12 of the connector, from each of a first side and an opposed, second side. The sockets 14 can receive a first mating element 26 from the first side or a second mating 28 element from the second side of the base 12. Conductors 18 in the sockets contact lateral sides of both the first and the second mating elements to provide an electrical connection between the first and the second mating element. The first and second element may also make direct contact with one another. As in the embodiment of FIG. 1, loading bands 24 extend along the row of sockets and are displaced and tensioned when mating elements are received in the connector. As shown, a first set of loading bands provide contact forces between the conductors and the first mating elements, and a second set of loading bands provide contact forces between the conductors and a second set of mating elements. Together, the contact forces provided by the loading bands help ensure a reliable electrical connection between the first and second mating elements and the conductor in each socket. It is to be appreciated that other embodiments of connectors can also provide electrical connections between mating elements, as aspects of the invention are not limited to the embodiment shown in FIG. 2.

Figure 3:
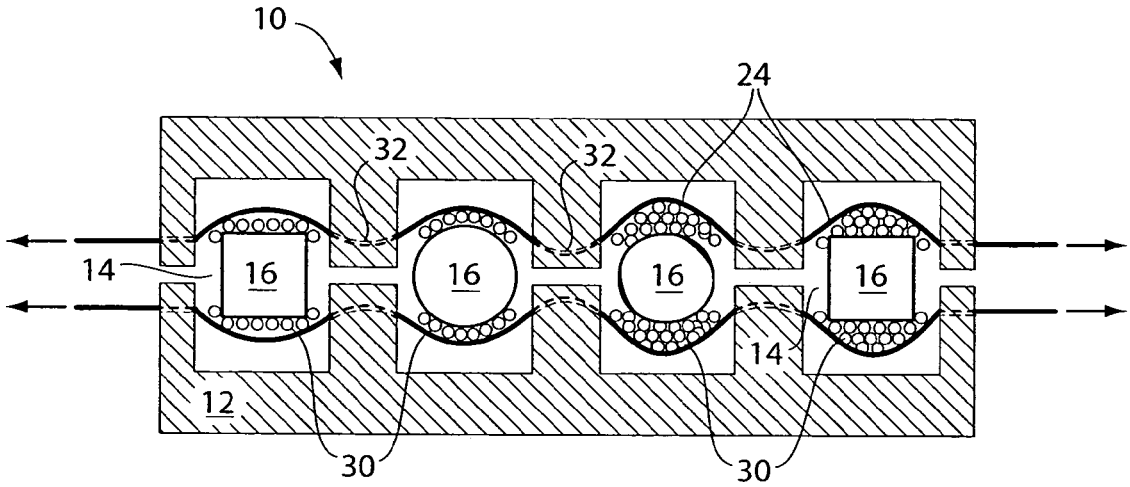
FIG. 3 shows a schematic plan view into the sockets of a connector with conductors that can conform to different shapes of mating elements.

In some illustrative embodiments of the invention, the conductors include individual elements, such as wires that can collectively conform to different shapes or sizes of mating elements. FIG. 3 shows a schematic view of a row the sockets 14 in one connector embodiment. The connector 10 is shown engaged with mating elements 16 that have either a square cross section or a circular cross section. The conductors 18 comprise individual wires that are grouped together on opposed sides of each socket 14. When the mating elements are present in the sockets, the individual wires can conform to the outer surface of the mating elements, regardless of the cross sectional shape of the mating element. The conductive wires 30 can be grouped such that each wire makes contact with the mating element, as shown on the left hand side of the connector 10 in FIG. 3, or such that only some of the conductive wires in a bundle are in direct contact with the mating element, as shown on the right hand side of FIG. 3.

Figure 4:
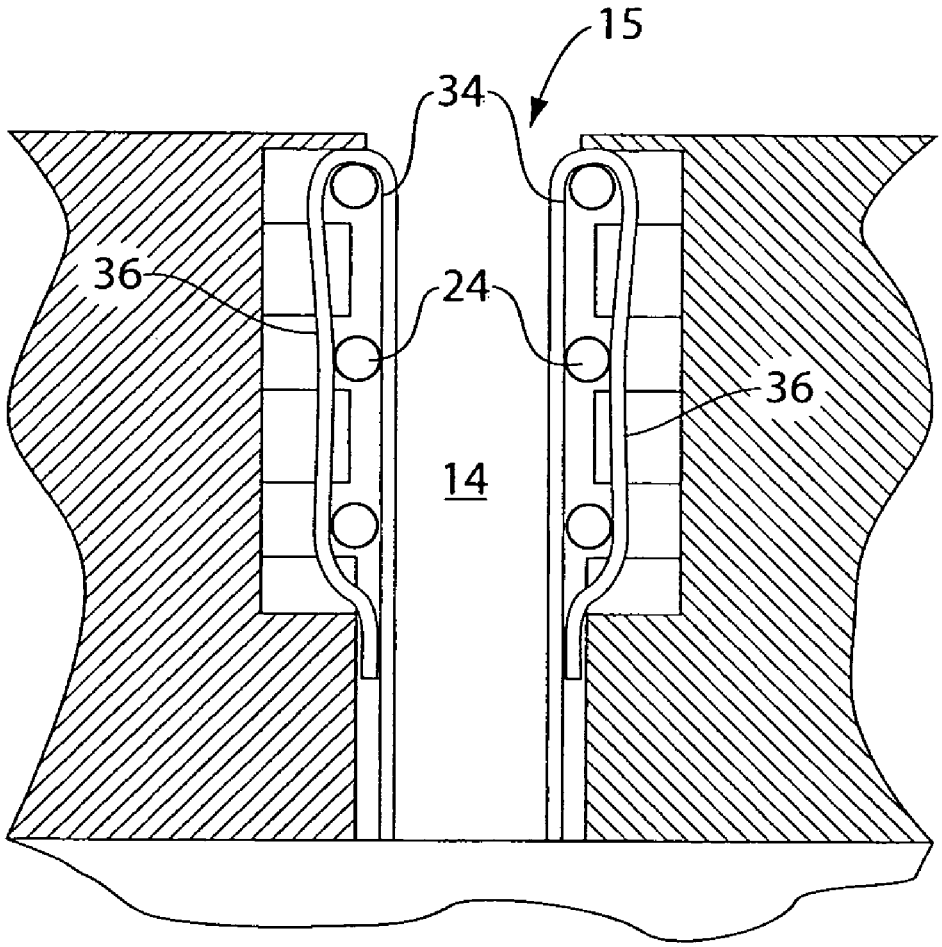
FIG. 4 shows an embodiment of connector having a conductor comprising a conductive wire wrapped about loading bands of a connector.

As mentioned above, the conductors in some illustrative embodiments include individual strands of conductive wire 30 that extend about loading bands 24 within the connector 10. FIG. 4 shows an example of such a conductive wire 30. Here, the conductors 18 comprise one or more individual wires that are folded about the loading band nearest to the opening 15 of the socket 14. The illustrated conductive wire has an internal leg 34 that extends along the internal portion of the socket 14 that is to receive the mating element. The internal portion of the internal leg is adapted to make contact with the mating element. In many embodiments, the internal leg 34 extends across all of the loading bands in an socket, but is not required to do so in all embodiments. The illustrated conductive wire 30 also has an external leg 36 that lies on the opposite side of the loading bands 24 as the socket 14. The external leg is shown to extend across each of the loading bands and to be terminated to the internal leg of the conductive wire. However, it is to be appreciated that the external leg may extend across only a portion of the loading bands. Still, in some embodiments, there may be no external leg at all. By way of example, in some embodiments the conductive wires are not wrapped around the loading band nearest to the opening of the socket or any bands at all, but rather are terminated to a point within the base near the opening. Still, other configurations of conductors or conductive wires are possible, as the present invention is not limited in this manner.

Figure 5:
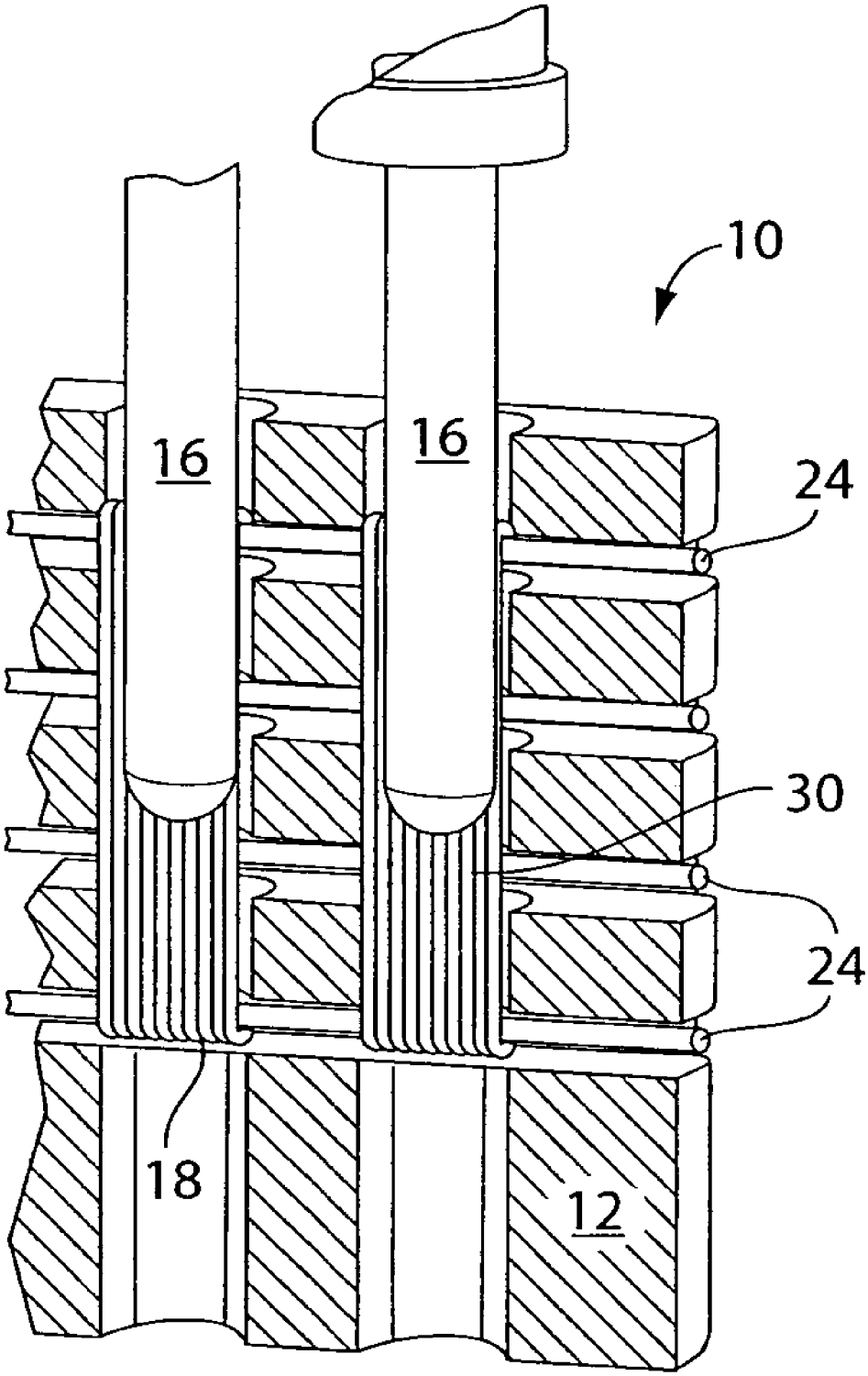
FIG. 5 shows an embodiment of a conductor comprising conductive wire wrapped in multiple loops about loading bands of a connector.

A single conductive wire can be configured with multiple internal legs lying adjacent to a mating element. FIG. 5 shows one embodiment of such a conductor 18, where a single conductive wire 30 is looped about a plurality of loading bands 24 multiple times. Such conductors can be particularly useful in embodiments that provide an electrical connection between two mating elements in a socket 14, given that the conductors in such embodiments are often not terminated elsewhere within the connector. Here, ends of the looped conductive wire can be terminated to the conductive wire itself to form a complete loop. Such embodiments are said to be "self terminated" as the term is used herein. It is to be appreciated that single conductors can be configured with multiple internal legs in manners other than shown in FIG. 5. By way of example, in some embodiments, a conductive wire may be folded back and forth on the internal side of the socket 14 adjacent to the loading bands 24.

As mentioned herein, the conductors in some embodiments can conform to mating elements of different cross sections. Conductors can be allowed to move within the sockets to accomplish this effect. By way of example, in some embodiments the conductive wires that comprise the conductors may be allowed to slide along the loading bands. FIGS. 4 and 5 show examples of such embodiments. FIG. 3 shows an example of how conductors that can slide along loading bands can conform to mating elements 16 having different cross sections. As shown, each of the conductive wires of conductor 18 can move to appropriate positions about the outer surface of a square contact or a round contact such that most or all of the conductive wires are in contact with the mating element. However, it is to be appreciated that conductors comprising conductive wires can conform to mating elements without necessarily sliding along the loading bands, or moving at all, as the present invention is not limited in this regard.

Conductors can also comprise bundles of conductive wires that do not each make contact with mating elements received in a socket. As is also shown in FIG. 3, bundles of conductive wires can be more flexible, for a given cross-sectional area, than some other constructions of conductors. This can be a desirable feature in applications where mating elements having a wide variety of cross sectional shapes and/or cross sectional sizes are to be accommodated. By way of example, such bundles of wires may conform to the corners of mating elements, such as the corners of square shaped, diamond shaped, and hexagonal shaped cross sectional mating elements. As with other embodiments of conductors, the wire bundles can provide numerous contact points with a mating element, which can increase the contact area between the conductors and the mating element, thereby increasing the achievable current density of a connector.

Embodiments of connectors can have conductors that contact opposed sides of mating elements, or only a single side of a mating element. By way of example, FIG. 3 shows mating elements 16 of a mating connector that contact conductors on opposed sides of sockets 14. In such embodiments, the conductors, loading bands and other components of the connector 10 can be constructed in a similar manner on each side of the socket 14, although this is not a requirement. By way of example, FIG. 1 shows half of a connector base including conductors, loading bands, and a loading element. The base 12 of FIG. 1 can be assembled with another mirror image half connector base. Assembling connectors in this manner can simplify the manufacturing process and reduce costs of producing the connector. However, it is to be appreciated that the half connector base could also be assembled with another connector base half that lacks conductors, such that sockets of the connector each only have conductors located on one side.

Opposed conductors within a socket can be electrically connected to one another, or electrically isolated from one another when a mating element is absent from the socket. In some embodiments, particularly those that receive mating elements from one side of the base 12 only, as shown in FIG. 1, the opposed conductors 18 may be terminated to a common conductive element in the connector. The common conductive element can be in the base, or external to the base, but in either case the conductive element can provide an electrical connection between the opposed conductors. In other embodiments it can be useful to have opposed conductors within a socket that are electrically isolated from one another. This may particularly be the case in embodiments of connectors that provide an electrical connection between two different mating elements 16, like that shown in FIG. 2. In such embodiments, each of the opposed conductors may only be providing an electrical connection between each of the mating elements received in two connected sockets, meaning that termination to another conductive element is not necessary. However, features can be included in such embodiments to electrically connect the opposed conductors, as the invention is not limited in this respect.

In some embodiments, opposed conductors 18 within a socket 14 can be used to provide a point for measuring the voltage value near to the point of the contact between the opposed conductors and a mating element 16. Such a feature can be useful when evaluating the voltage drop across a component attached to the connector. That is, voltage can be measured at one of the electrically isolated, opposed conductors to provide a voltage value very near to the point of contact between the mating element and the conductors.

Some embodiments of connectors can include multiple sets of opposed connectors, each adapted to contact a common mating element. By way of example, one embodiment has a pair of opposed conductors that each contact opposed lateral sides of a common mating element. In some of such embodiments, one of the pair of opposed conductors is used to transmit power through the connector while the other of the pair of opposed conductors is used to sense a voltage value in the mating element. Such pairs of opposed conductors can be constructed in any of the manners described herein. Other embodiments can include any different numbers of opposed conductors as the present invention is not limited in this regard.

As mentioned above, the loading bands 24 can be positioned in a connector 10 such that they are displaced by a mating element 16 that is received in the connector. Displacing the loading band places it in tension, which in turn causes the loading band to apply a contact force between the corresponding conductor 18 and the mating element. In some embodiments, loading guides 32 are positioned on either side of sockets in the connector to hold the loading band in position when the mating element is present in the socket. In this regard, the loading guides can help control the contact forces between the mating element and conductors.

Loading bands can apply contact forces to separate contact areas between conductors and mating elements. In some embodiments where the conductors comprise multiple conductive wires, the contact area between the conductors and the mating element may occur along a plurality of lines of contact that are parallel the longitudinal axis of the mating element. In some embodiments, particularly those with multiple loading bands associated with each conductor, there may be multiple separate contact areas between the conductors and the mating element, each associated with one of the loading bands. However, in other embodiments, the contact area may extend along the conductor and mating element between areas associated with each of the loading bands. In some embodiments, the contact area between the mating element and the conductor that is near the loading band may be characterized by an elliptical or Herzian contact area. However, other contact areas may result between the conductors and mating elements, as the present invention is not limited in this respect.

Illustrative embodiments of connectors can have different numbers of loading bands to apply contact forces between conductors 18 and mating elements. By way of example, the embodiment of FIG. 1 shows four loading bands 24 that each apply a contact force between each of the conductors and corresponding mating elements 16 located in each socket 14. As discussed above, the mating half of the connector 10 in FIG. 1 (not shown) can include an opposed conductor 18 in each of the sockets. In such embodiments, any number of loading bands 24 can be used to apply contact forces between the opposed conductors and the mating elements. However, as discussed above, the mating half of the connector 10 does not require any loading bands, as aspects of the invention are not limited in this regard.

Embodiments of connectors that electrically connect two mating elements 16 together, like that shown in FIG. 2, frequently have at least two loading bands that span a common side of a conductor. In this regard, at least one loading band can apply a contact force to each of the two mating elements present that are in contact with the conductor to help insure a reliable electrical connection there between. However, embodiments of such connectors can have only a single loading band, or more than two loading bands, as they are not limited in this respect. By way of example, the embodiment FIG. 2 shows four loading bands on one half of the connector. Two each of the four illustrated bands apply contact forces between the conductor and each of the two mating elements.

Figure 6A:
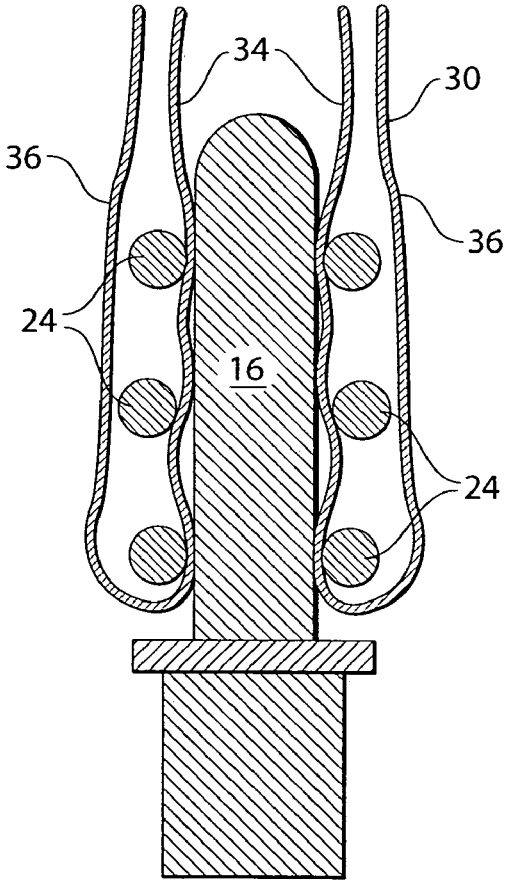
FIGS. 6*a*–6*b* show cross sectional views of loading bands arranged in different configurations in a connector.
Figure 6B:
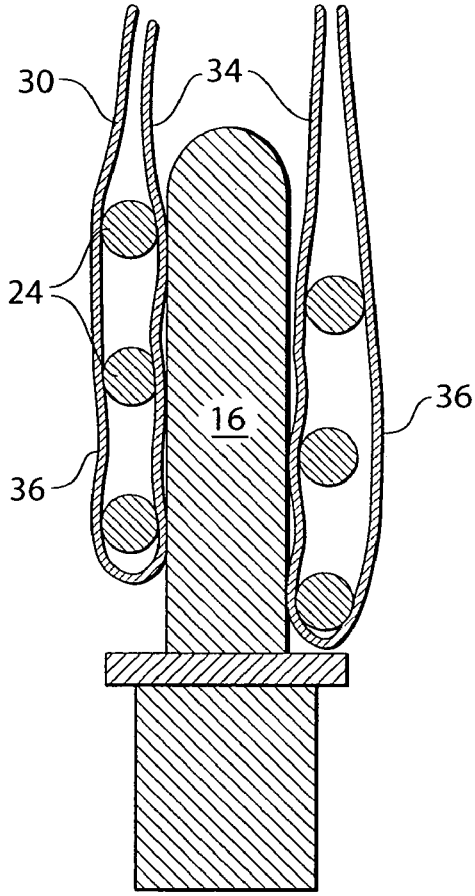

In some embodiments of connectors, there are an equal number of loading bands associated with each of the opposed conductors in a socket. The loading bands associated with the opposed conductors can be positioned such that they lie in a common plane. FIG. 6*a* shows a cross section of a connector with loading bands arranged in this manner. Alternately, some embodiments can have the loading bands on one side staggered with respect to loading bands on an opposite side of a socket 14, as is represented by FIG. 6*b*. Still, other embodiments can have combinations of loading bands that lie in a common plane (where the plane lies orthogonal to a central axis of the socket) and loading bands that are staggered with respect to one another, as aspects of the invention are not limited in this regard.

Loading bands can extend along multiple sockets in a connector to help increase the current density of a connector. For example, FIGS. 1 and 2 show loading bands that extend along an entire row of sockets 14 in a connector. The base 12 of the connector 10 includes a passageway that allows the loading bands to be placed adjacent to each of the sockets. The passageway also allows for at least some minimal movement of loading bands 24 along the longitudinal direction of the passageway as the bands are tensioned. Although these illustrated embodiments have loading bands that span an entire row of sockets, other embodiments can be configured differently. By way of example, some embodiments can have only a single socket 14. Still, some embodiments with multiple sockets can have loading bands that span only portions of the sockets, or that even span only individual sockets in the connector, as aspects of the invention are not limited in this manner.

In some illustrative embodiments, loading guides 32 can be included on either side of a socket 14 in the connector 10 to hold portions of the loading band in position relative to the mating element 16. FIGS. 1 and 2 show an example of such loading guides that are incorporated into the passageways running through the base 12 of the connector. When the mating element is received in the socket 14, the conductor 18 and associated loading bands are displaced away from the central, longitudinal axis of the socket, which can place the loading band in tension. The position of the loading guides can help hold the conductor in contact with the mating element and can also help define the magnitude of the contact force. In some embodiments, loading guides are shaped and positioned similarly on either side of each socket. However, in other embodiments, they can be shaped and/or positioned differently to accomplish various effects, such as providing different contact forces in different sockets or for accommodating different shapes/sizes of mating elements in different sockets. Still, in some embodiments, adjacent conductors and/or mating elements can serve as loading guides. It is to be appreciated that not all embodiments require loading guides, as aspects of the invention are not limited in this regard.

Figure 7:
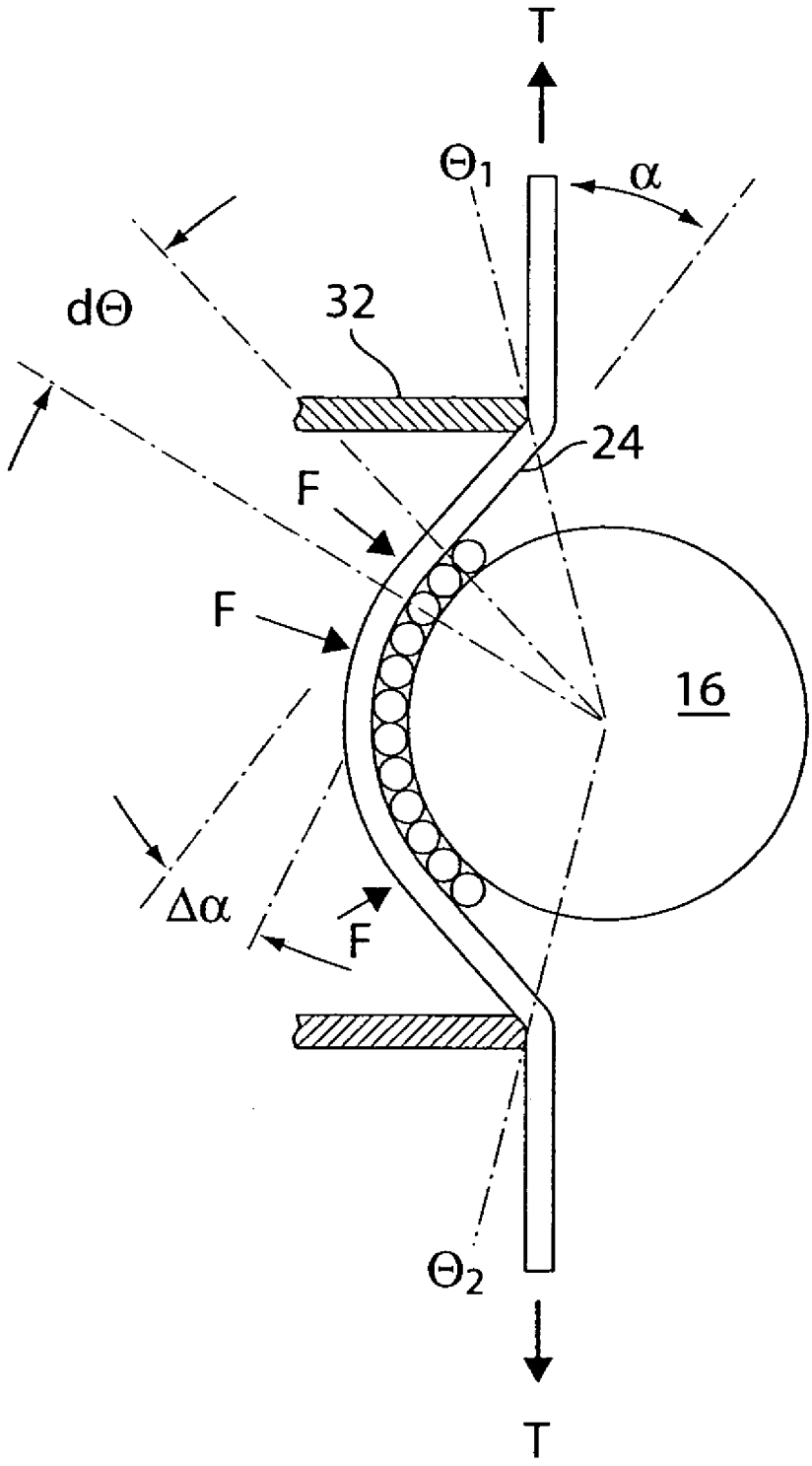
FIG. 7 shows a schematic diagram of the geometry between a loading band, loading guides, a conductor and a mating element resulting in contact forces between the conductor and the mating element.

The mechanics of engagement between the loading bands, loading guides, conductors and mating elements, which result in the contact forces are generally represented in FIG. 7. As shown, the net normal force applied to a mating element by a given loading band can be estimated with Eq. 1 below.

$$F = 2T\int_{\theta_1}^{\theta_2} \sin(\Delta\alpha)\, d\theta. \qquad \text{Eq. 1}$$

where:

F=Net normal contact force between a mating element and a conductor that is associated with a given loading band T=Tension of the loading band $\Delta\alpha$=Change in angle of the loading band across portions of the conductor As is to be appreciated, the contact force between the mating element and a conductor can be altered through various techniques. As described herein, the number of loading bands associated with a given mating element and conductor can be increased, which will increase the overall force applied to a mating element from a given side of the socket, all else constant. In some embodiments, the angle between the loading band and the plane lying between loading guides on either side of a socket can be altered to, in turn, alter the normal contact forces. By way of example, the loading guides can be placed closer to a central portion of the connector to increase the change in angle '$\alpha$' associated with portions of the conductor, and thus increase corresponding normal contact forces. In other embodiments, a thicker conductor or a greater number of conductive wires in a conductor can be used to increase the change in angle '$\alpha$' to accomplish a similar effect. Still, other techniques can be used to change the contact force, as aspects of the invention are not limited to those discussed above.

Various mechanisms can be used to provide elasticity to the loading band such that it can be displaced when a mating element is inserted into an socket. In one illustrative embodiment, the loading band is made of an elastic material so that the loading band itself can stretch to be placed in tension as mating elements are received in the sockets. In some embodiments, like those shown in FIGS. 1 and 2, the loading bands are attached at one end to a loading element 22 also present in the connecter and to the base at the other end. In such embodiments where the loading band is not required to be elastic, it may be made of inextensible materials, such as nylon, fluorocarbon, polyaramids and paraaramids (e.g., Kevlar®, Spectra®, or Vectran®), polyamids, conductive metals and natural fibers, such as cotton, and the like. In one such embodiment, the loading band is connected at one or both ends to one or more loading elements. As shown in FIGS. 1 and 2, the base 12 of the connector can have a pocket 20 that contains a loading element, such as a U-spring attached to each of the loading bands on one side of the connector. The U-spring extends as the loading bands are displaced to help define the contact forces between conductors and mating elements. Such loading elements can be used with inextensible loading bands, or in combination with loading bands that have elastic characteristics. Also, loading elements are not limited to U-springs like that shown in FIGS. 1 and 2, but rather can include any suitable elastic element, such as an elastomeric compound about which a portion of a loading band is connected. As shown in FIGS. 1 and 2, embodiments can have a common loading element connected to multiple loading bands, while other embodiments have individual loading elements for each loading band, or for sets of loading bands. Still, other materials and constructions may be used as the invention is not limited to those listed above.

The loading band can be tensioned in different ways within different embodiments of connectors. By way of example, in some connectors, the loading band may have an initial tension prior to mating elements being inserted into sockets of the connector. In this sense, the loading bands may be "pre-tensioned". The loading bands are then tensioned further when mating elements are received in the sockets. In other embodiments, the loading bands are in a relaxed state until mating elements are inserted into sockets of the connector. Also, in some embodiments the loading bands and associated elements can be configured such that similar contact forces are applied to mating elements of different sizes. By way of example, in some embodiments, the loading bands and/or the loading elements are configured such that the tension in the loading band remains substantially constant over the range of displacement that the bands are expected to experience. However, in other embodiments, the tensioning bands can exhibit much greater tensions and associated forces as they are displaced, as the present invention is not limited in this respect.

Loading guides within the connector can have features to facilitate movement of the loading band. As may be appreciated, the loading band, in some embodiments may slide against the loading guide as the conductor is displaced during engagement with a mating connector. The interface between the loading guide can have features to minimize wear and/or friction with the loading band. Such features can include rounded edges, resilient materials, and/or low friction materials at the interface. The low friction material can be the material of the base itself, or can include an additional element affixed to the base at the interface. Still, in other embodiments, coatings or lubricants may be applied to the loading band and/or interface to reduce friction and/or decrease wear. However, the invention is not limited in this respect, and in some embodiments, a certain amount of friction may be desirable. In some connector embodiments, the loading guides can be movable, rather than fixed as shown in the figures. Movable loading guides can include elastomeric materials placed between the loading band and the base. In other embodiments, movable loading guides can include spring loaded elements that move as loading bands are displaced. Movable loading guides can be used in some embodiments to alter the contact forces between the conductors and the mating elements. Still, in some embodiments, loading guides can be used to increase the range of sizes of mating elements that can be received within the socket of a connector. It is to be appreciated that not all embodiments of the invention include such features, as the invention is not limited to the constructions of loading guides described above or to having loading guides at all.

As discussed herein, connectors can be configured such that the contact forces associated with individual sockets can be different relative to other sockets in the connector when connected to similar mating elements. Additionally, features can be altered within a design to affect the magnitude of different contact forces applied to a common mating element by different loading bands. In this sense, the contact force profile across different sockets of a connector, or even among different contact areas of a mating element in a common socket, can be established. By way of example, the effective spring constant associated with the tensioning of the loading band can be increased to, in turn, increase the average contact force of contact areas associated with that loading band. In another example, the change in angle '$\alpha$' associated with conductors of some sockets can be increased to increase the contact forces applied against portions of a mating element in that socket. Still, other methods and features can be used to adjust the profile of contact forces against each mating element, or across all mating elements as may suit particular applications.

The loading band may include features that are suited for particular applications. In some illustrative embodiments, the loading band comprises an electrically conductive material. In this regard, the loading band can provide an additional pathway for current flow through the connector and between different mating elements present in the connector. Such features may be desirable in some power connector applications. In some embodiments, the loading band is shaped as a ribbon with two opposed and substantially flat surfaces, while in other embodiments the loading band can comprise a fiber or strand having a circular cross section, as the term "loading band" is not limited to ribbon like constructions.

Embodiments of the electrical connector allow materials with optimal electrical characteristics to be used as conductors, and materials with optimal mechanical characteristics to provide contact forces between the conductors and mating elements. Although the conductors of the electrical connector may move and/or flex when the connector is engaged with a mating element, they are not required to generate the contact force in many embodiments—thus allowing the conductors to be chosen primarily for electrical properties instead of a combination of electrical and mechanical properties. Similarly, the loading bands, any associated loading elements, and any loading guides in the base can be used to provide a mechanical contact force between the conductors and the mating elements. In this regard, the loading bands, loading elements, and loading guides can be chosen primarily for their mechanical characteristics.

In many embodiments the mechanical properties of individual conductors do not contribute significantly to the associated contact force of the conductor. However, in other illustrative embodiments, the forces associated with moving individual conductors within a connecter can contribute to the contact force, even substantially, as aspects of the invention are not limited in this respect.

As discussed herein, constructing the connector with a loading band to provide contact forces, instead of having the conductors themselves provide the contact force, allows the conductors to be made of a material that has optimal electrical properties. By way of example, high conductivity copper alloys can be used in embodiments of the present invention without concerns of the material being unable to provide an adequate contact force over time or after repeated cycles of dis-engagement and re-engagement. However, it is to be appreciated that embodiments of the present invention are not limited to having conductors made of high conductivity copper alloys, and that other conductive materials, such as other copper alloys, aluminum, gold and the like may be suitable as well.

The loading mechanism of the connector, such as the loading band and/or loading elements, may also be chosen with optimal mechanical characteristics in mind—rather than compromising for a mechanism or material that has both appropriate mechanical and electrical properties. As discussed herein, the loading bands are not required to carry an electrical current within the connector. In this regard, the loading band and any other features of the connector that help provide the contact force, may be chosen with the mechanics of the connector in mind.

In the embodiments illustrated in the figures, the mating elements are inserted into the sockets and then contact the conductors in sliding contact. However, not all embodiments of the invention have conductors engage mating elements in sliding contact. By way of example, some embodiments of the invention can include a base with two halves that are brought together to sandwich one or more mating elements. Still, other arrangements can be configured to engage the mating elements in different manners, as aspects of the invention are not limited in this regard.

The embodiments illustrated in the figures include sockets that are defined by a base and conductors in the base. The sockets include circular openings that receive mating elements and that can help guide the mating elements into engagement with the connector. In other embodiments, the base or other portions of the connector can have features that help align the connector with the mating connector and/or that lock them together in engagement. However, it is to be appreciated that aspects of the invention are not limited to having sockets or a base as shown in the figures. By way of example, in some embodiments, the base can have a single opening that spans multiple sockets of the connector. In this respect, features other than the base can define the sockets. For instance, in some embodiments the sockets are defined by opposed conductors and adjacent loading guides instead of the base.

It is to be appreciated that embodiments of the present invention can be adapted for use in a wide variety of applications. Some of the more prevalent applications include power and/or data transmission. A connector housing may include multiple arrays of conductors, in a row or in a grid, each used to transmit power or data, or combinations of arrays used for either purpose. Additionally, conductors within a given array may be connected to a common conductor within the housing, or may be connected to individual conductors within the housing that are used for similar or different purposes. It is to be appreciated that variations, such as those mentioned above, and others, can be made without departing from aspects of the invention as those of skill will appreciate.

Embodiments of the invention may be produced using any technique or component (or any suitable combination thereof) described in any of U.S. patent application Ser. No. 10/985,322 (filed Nov. 10, 2004), Ser. No. 10/850,316 (filed May 20, 2004 and now published under publication no. 2004-0214454 A1), Ser. No. 10/603,047 (filed Jun. 24, 2003 and now published under publication no. US 2004-0005793 A1), Ser. No. 10/375,481 (filed Feb. 27, 2003 and now published under publication no. US 2004-0048500 A1), Ser. No. 10/273,241 (filed Oct. 17, 2002 and now published under publication no. US 2003-0134525 A1), and U.S. provisional patent application Ser. No. 60/348,588 (filed Jan. 15, 2002), each of which is assigned to the assignee of the present application and each of which is hereby incorporated by reference in its entirety.

Having thus described certain embodiments of an electrical connector, various alterations, modifications and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalent thereof.

What is claimed is:

1. A multi-socket electrical connector comprising:

an insulating base;

a plurality of sockets on a first side of the base, each socket constructed and arranged to receive a corresponding mating element of a mating connector;

a first conductor associated with each socket, the first conductor of each socket adapted to contact a first lateral side of the corresponding mating element;

a first loading band associated with the plurality of sockets such that the first loading band is common to each of the plurality of sockets, the first loading band adapted to be tensioned to provide a contact force between the first conductor of each socket and the corresponding mating element;

a second conductor opposed from the first conductor of each of the plurality of sockets, the second conductor adapted to make electrical contact with the mating element on a second lateral side of the corresponding mating element; and a second loading band adapted to be tensioned to provide a contact force between the second conductor of each socket and the corresponding mating element.

2. The multi-socket electrical connector of claim 1, wherein the first loading band comprises a first plurality of loading bands adapted to provide contact forces between the first conductor of each of the plurality of sockets and the corresponding mating element.

3. The multi-socket electrical connector of claim 2, wherein the first conductor comprises a plurality of conductive wires that extend around the first plurality of loading bands.

4. The multi-socket electrical connector of claim 2, wherein the first conductor comprises a single conductive wire that extends around the first plurality of loading bands multiple times.

5. The multi-socket electrical connector of claim 2, wherein the first conductor of each of the plurality of sockets is adapted to make contact with the corresponding mating element at a plurality of distinct contact areas, each of the plurality of distinct contact areas associated with one of the first plurality of loading bands.

6. The multi-socket electrical connector of claim 2, wherein the second loading band comprises a second plurality of loading bands adapted to provide contact forces between the second conductor of each of the plurality of sockets and the corresponding mating element.

7. The multi-socket electrical connector of claim 6, wherein the second conductor comprises a plurality of conductive wires that extend around the second plurality of loading bands.

8. The multi-socket electrical connector of claim 6, wherein the second conductor comprises a single conductive wire that extends around the second plurality of loading bands multiple times.

9. The multi-socket electrical connector of claim 6, wherein the second conductor of each of the plurality of sockets is adapted to make contact with the corresponding mating element at a plurality of distinct contact areas, each of the plurality of distinct contact areas associated with one of the second plurality of loading bands.

10. The multi-socket electrical connector of claim 6, wherein loading bands of the first plurality of loading bands are staggered with respect to loading bands of the second plurality of loading bands.

11. The multi-socket electrical connector of claim 1, wherein the first and second conductors of each socket are electrically connected to one another.

12. The multi-socket electrical connector of claim 11, wherein the first and second conductors are terminated to a separate conductive element in the base.

13. The multi-socket electrical connector of claim 1, wherein the first and second conductors in each socket are electrically isolated from one another when the corresponding mating element is absent.

14. The multi-socket electrical connector of claim 1, wherein the first and the second conductors comprise a high conductivity copper alloy.

15. The multi-socket electrical connector of claim 1, wherein the first and the second loading bands are tensioned when mating elements are absent from any of the plurality of sockets and wherein the first and second loading bands are further tensioned upon a mating element being received in any of the plurality of sockets.

16. The multi-socket electrical connector of claim 1, wherein the first and second loading bands are initially tensioned upon a mating element being received in one of the plurality of sockets.

17. The multi-socket electrical connector of claim 1, wherein the first and second loading bands provide substantially all of the contact force between the conductor of each socket and the corresponding mating element.

18. The multi-socket electrical connector of claim 1, wherein the first and second conductors of each of the plurality of sockets are adapted to conform to the corresponding mating element.

19. The multi-socket electrical connector of claim 1, wherein the plurality of sockets are in a substantially linear row and further wherein the plurality of sockets are defined by the base.

20. The multi-socket electrical connector of claim 1, further comprising:

loading guides associated with each of the plurality of sockets to position portions of the first and second loading bands when the corresponding mating element is received.

21. The multi-socket electrical connector of claim 20, wherein the loading guides are stationary portions of the base.

22. The multi-socket electrical connector of claim 1, wherein the base comprises two separable halves, each of the separable halves combinable to form the plurality of sockets when connected to one another.

23. The multi-socket electrical connector of claim 1, wherein the first and the second loading bands are made of a substantially inextensible material and are each connected to a loading element that allows the loading band to be displaced and tensioned.

24. The multi-socket electrical connector of claim 23, wherein the loading element is a spring located in the base.

25. The multi-socket electrical connector of claim 1, wherein the first and second loading bands comprise an elastic material.

26. The multi-socket electrical connector of claim 1, wherein the first and second conductors are each adapted to engage the corresponding mating element in sliding contact.

27. The multi-socket electrical connector of claim 1, in combination with the mating connector, wherein the mating elements of the mating connector have round cross sections.

28. The multi-socket electrical connector of claim 1, in combination with the mating connector, wherein the mating elements of the mating connector have square cross sections.

29. An electrical connector comprising:

an insulating base;

a first socket on a first side of the base and extending inwards of the base, the first socket constructed and arranged to receive a first mating element of a mating connector from the first side;

a second socket on a second side of the base and extending inward of the base from the second side, the second socket constructed and arranged to receive a second mating element of a mating connector from the second side;

a first conductor associated with the socket, the first conductor adapted to contact the first mating element when present in the socket and to contact the second mating element when present in the socket;

a first loading band in the base adapted to be tensioned to provide a contact force between the first conductor and the first mating element when present in the socket, the first loading band being a separate element from the first conductor; and a second loading band in the base adapted to be tensioned to provide a contact force between the first conductor and the second mating element when present in the socket, the second loading band being a separate element from the first conductor.

30. The electrical connector of claim 29, wherein the first side and the second side are opposed sides of the base.

31. The electrical connector of claim 30, wherein the first and the second sockets are axially aligned with one another.

32. The electrical connector of claim 29, further comprising:

a second conductor opposed from the first conductor, the first and second conductors adapted to make electrical contact with each of the first and second mating elements;

a third loading band adapted to be tensioned to provide a contact force between the second conductor and the first mating element; and a fourth loading band adapted to be tensioned to provide a contact force between the second conductor and the second mating element.

33. The electrical connector of claim 32, wherein each of the first and second loading bands comprise a first and a second plurality of loading bands, respectively, each of the first and second plurality of loading bands adapted to provide contact forces between the first conductor and each of the first and the second mating elements, respectively.

34. The electrical connector of claim 33, wherein each of the third and fourth loading bands comprise a third and fourth plurality of loading bands, respectively, each of the third and fourth plurality of loading bands adapted to provide contact forces between the second conductor and each of the first and the second mating elements, respectively.

35. The electrical connector of claim 34, wherein the first and second conductors are each adapted to make contact with the first mating element at a plurality of distinct contact areas.

36. The electrical connector of claim 35, wherein the first and second conductors are each adapted to make contact with the second mating element at a plurality of distinct contact areas.

37. The electrical connector of claim 34, wherein the first conductor comprises a plurality of conductive wires that extend about the first and second plurality of loading bands.

38. The electrical connector of claim 34, wherein the first conductor comprises a single conductive wire that is wrapped multiple times about the first and second plurality of loading bands.

39. The electrical connector of claim 34, wherein the second conductor comprises a plurality of conductive wires that extend about the third and fourth plurality of loading bands.

40. The electrical connector of claim 34, wherein the second conductor comprises a single conductive wire that is wrapped multiple times about the third and fourth plurality of loading bands.

41. The electrical connector of claim 33, wherein the first and second conductors are electrically isolated from one another absent the first and second mating elements.

42. The electrical connector of claim 33, wherein the first and the second conductors comprise a high conductivity copper alloy.

43. The electrical connector of claim 33, wherein each of the first and third loading bands are in tension when the first mating element is absent from the socket.

44. The electrical connector of claim 33, wherein each of the first and third loading bands are untensioned when the first mating element is absent from the socket.

45. The electrical connector of claim 33, wherein the first and second conductors are adapted to conform to a shape of the first or second mating elements.

46. The electrical connector of claim 33, wherein the socket comprises a plurality of sockets.

47. The electrical connector of claim 46, wherein the plurality of sockets are in a substantially linear row.

48. The electrical connector of claim 33, further comprising:

loading guides adjacent to the socket, the loading guides adapted to position portions of the first and third loading bands with respect to the first mating element when received in the socket.

49. The electrical connector of claim 48, wherein the loading guides are stationary portions of the base.

50. The electrical connector of claim 33, wherein the first and second loading bands are made of a substantially inextensible material and are each connected to a loading element that allows the loading band to be displaced and tensioned.

51. The electrical connector of claim 33, wherein the first and second loading bands comprise an elastic material.

52. The electrical connector of claim 33, wherein the first and second conductors are each adapted to engage the first and second mating elements in sliding contact.

53. The electrical connector of claim 33, wherein the first and second conductors comprise a high conductivity copper alloy.

54. A method for engaging a multi-socket electrical connector with a plurality of mating elements, the method comprising:

providing an electrical connector having a plurality of sockets;

inserting each of a plurality of mating elements of a mating connector into a corresponding socket of the electrical connector;

contacting a lateral side of each of the plurality of mating elements of the mating connector to a first conductor of the corresponding socket of the electrical connector;

displacing a first loading band in the electrical connector to provide a contact force between each of the plurality of mating elements and the first conductor of the corresponding socket; wherein the first loading band is associated with the plurality of sockets such that the first loading band is common to each of the plurality of sockets;

contacting each of the plurality of mating elements of the mating connector to a second conductor of the corresponding socket; and displacing a second loading band in the electrical connector to provide a contact force between each of the plurality of mating elements and the second conductor of the corresponding socket.

55. A method for engaging a first and a second male electrical elements, the method comprising:

inserting the first male element into a first socket of an electrical connector;

displacing a first loading band in the electrical connector to provide a first contact force between the first element and a conductor of the socket, the first loading band being a separate element from the conductor;

inserting the second male element into a second socket of the electrical connector; and displacing a second loading band in the electrical connector to provide a second contact force between the second element and the conductor of the socket, the second loading band being a separate element from the conductor.

56. A multi-socket electrical connector comprising:

an insulative base;

a plurality of sockets disposed substantially in a linear row on a first side of the base and extending inwardly of the base in a first direction, each socket constructed and arranged to receive a corresponding mating element of a mating connector;

a plurality of wire conductors disposed in each socket, at least some of the plurality of wire conductors adapted to contact the corresponding mating element;

a plurality of tensioned loading bands associated with the plurality of sockets such that the plurality of tensioned loading bands is common to each of the plurality of sockets, the plurality of tensioned loading bands engaging at least some of the plurality of wire conductors in each socket, each loading band anchored to the insulative base and adapted to be tensioned upon the corresponding mating element being received in each socket, whereby the loading band provides multiple points of contact between the at least some of the plurality of wire conductors and the corresponding mating element.

* * * * *